United States Patent [19]

Dielacher et al.

[11] Patent Number: 4,751,454

[45] Date of Patent: Jun. 14, 1988

[54] TRIMMABLE CIRCUIT LAYOUT FOR GENERATING A TEMPERATURE-INDEPENDENT REFERENCE VOLTAGE

[75] Inventors: Franz Dielacher; Jochen Reisinger, both of Villach, Austria

[73] Assignee: Siemens Aktiengesellschaft, Berlin and Munich, Fed. Rep. of Germany

[21] Appl. No.: 913,413

[22] Filed: Sep. 29, 1986

[30] Foreign Application Priority Data

Sep. 30, 1985 [DE] Fed. Rep. of Germany ..... 3534891

[51] Int. Cl.[4] ..... G05F 3/20

[52] U.S. Cl. ..... 323/314; 323/351; 323/907

[58] Field of Search ..... 323/312–314, 323/350, 351, 907; 307/297

[56] References Cited

U.S. PATENT DOCUMENTS

| | | | |
|---|---|---|---|
| 4,100,437 | 7/1978 | Hoff, Jr. | 307/297 |
| 4,325,018 | 4/1982 | Schade, Jr. | 323/313 |
| 4,396,883 | 8/1983 | Holloway et al. | 323/313 |
| 4,472,675 | 9/1984 | Shinomiya | 323/907 X |
| 4,590,418 | 5/1986 | Moriarty et al. | 323/313 |
| 4,608,530 | 8/1986 | Bacrania | 323/351 X |
| 4,633,165 | 12/1986 | Pietkiewicz et al. | 323/314 |

OTHER PUBLICATIONS

Tietze et al., *Halbleiter-Schaltungstechnik,* (Berlin: Springer, 1980), pp. 386–390.

*Electronic Design,* vol. 26, No. 23, pp. 74–82.

*Primary Examiner*—Patrick R. Salce

*Assistant Examiner*—Marc S. Hoff

*Attorney, Agent, or Firm*—Herbert L. Lerner; Laurence A. Greenberg

[57] ABSTRACT

Circuit for generating a temperature-independent reference voltage includes transistors forming current sources, and a band gap circuit having bipolar transistors and being supplied by the current sources, the ratio of the emitter currents of the bipolar transistors being adjustable. The current sources may further include a first current source and a second current source parallel with the first current source.

12 Claims, 1 Drawing Sheet

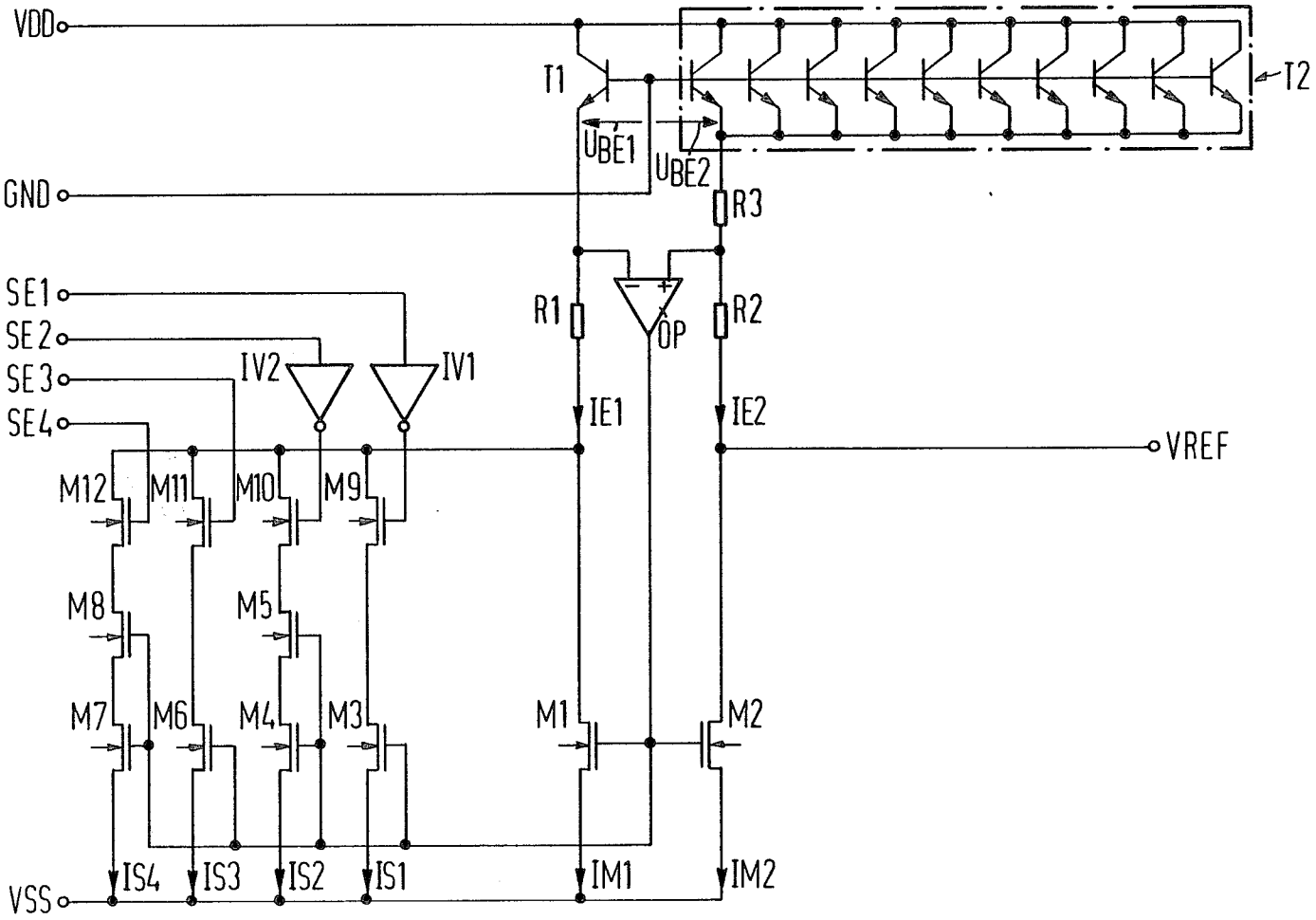
T2
VREF
R3
R2
IE2
M2
IM2
UBE2
OP
UBE1
IE1
IM1
T1
R1
M1
IV1
IS1
M9
M3
IV2
IS2
M10
M5
M4
IS3
M11
M6
IS4
M12
M8
M7
VDD
GND
SE1
SE2
SE3
SE4
VSS

TRIMMABLE CIRCUIT LAYOUT FOR GENERATING A TEMPERATURE-INDEPENDENT REFERENCE VOLTAGE

The invention relates to a circuit for generating a temperature-independent reference voltage, including transistors forming current sources and a band gap circuit supplied by the current sources and having bipolar transistors.

In virtually all circuitry using integrated analog circuits, reference voltages are required. They are supposed to be constant under all operating conditions and should either have no temperature drift, or a defined temperature drift. Band gap circuits are preferred for generating the reference voltages, especially in integrated circuits themselves. Band gap circuits are described, for example, in the book entitled "Halbleiter-Schaltungstechnik" (Semiconductor Switching Techniques) by U. Tietze and Ch. Schenk, 5th revised edition, published by Springer Publishers, Berlin, Heidelberg and New York, 1980, pp. 387 et seq.

In the above-mentioned publication, it is explained that by means of such band gap circuits, reference voltages can be generated that are independent of the temperature coefficient of the components used therein; that is, in the ideal case, such a circuit furnishes a temperature-independent reference voltage, which corresponds to the band gap of the semiconductor material. For silicon, which is often used, this relatively temperature-independent differential voltage is 1.205 V. In principle, a band gap circuit uses the base-to-emitter voltage of a transistor as a reference, the negative temperature coefficient of the transistor being compensated for by the addition of an electrical variable with the dimension of "voltage", having a positive temperature coefficient. The voltage variable is formed from the difference in the base-to-emitter voltages of two transistors driven with different currents and can be tapped by a resistor.

However, these considerations ideally apply for only a single temperature, at which the negative temperature coefficient of the base-to-emitter voltage of the transistor is exactly compensated for by the positive temperature coefficient of the voltage formed by the resistor and by the current flowing therethrough. Since in a first approximation the voltage having a positive temperature coefficient increases linearly with the temperature, but the base-to-emitter voltage of a transistor decreases non-linearly with the temperature, an approximate compensation for the temperature coefficient is at best possible within a narrow temperature range. In practice, an attempt is made to dimension and produce band gap circuits in such a way that they are matched to this relatively narrow temperature range as well as possible.

Even without taking temperature effects of a relatively high order into consideration, this requirement can be met only with difficulty because of unintended variations, such as errors in the geometry of the transistor and resistor regions associated with manufacturing processes, or parasitic effects on the part of the materials used.

It is accordingly an object of the invention to provide a circuit for generating a reference voltage, which overcomes the hereinafore-mentioned disadvantages of the heretofore-known devices of this general type and that is as independent of temperature as possible.

With the foregoing and other objects in view there is provided, in accordance with the invention, a circuit for generating a temperature-independent reference voltage, comprising transistors forming current sources, a band gap circuit having bipolar transistors and being supplied by the current sources, and means for adjusting the ratio of the emitter currents of the bipolar transistors.

The invention is based on the concept of being able to match the currents through the transistors of the band gap circuit and various base-to-emitter voltages to one another, even after the manufacture of the band gap circuit, in such a way that the temperature coefficients having different signs (+ or −) compensate for one another as well as possible. To this end, two currents supplying these transistors are used, the ratio between them being adjustable by means of switching on or switching off current sources.

In accordance with another feature of the invention, the current sources include a first current source and second switchable current sources parallel to the first current source.

In accordance with a further feature of the invention, there are provided means for individually switching the second current sources.

In accordance with an added feature of the invention, there are provided means for switching on a portion and switching off a portion of the second current sources.

In accordance with an additional feature of the invention, the switching means are in the form of transistors.

In accordance with yet another feature of the invention, the second current sources supply currents weighted in binary fashion.

In accordance with yet a further feature of the invention, the second current sources are formed of identical transistors of one conduction type being connected in parallel or in series.

In accordance with yet an added feature of the the invention, the transistors of the current sources and the transistors of the switching means are metal oxide semiconductors.

In accordance with a concomitant feature of the invention, the bipolar transistors of the band gap circuit have ring emitters disposed about a base contact.

Other features which are considered as characteristic for the invention are set forth in the appended claims.

Although the invention is illustrated and described herein as embodied in trimmable circuit for generating a temperature-independent reference voltage, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single figure of the drawing.

The FIGURE of the drawing is a schematic circuit diagram of an embodiment of the invention for generating a trimmable band gap voltage reference.

Referring now to the FIGURE of the drawing in detail, there are seen elements T1, T2, M1, M2, R1 to R3 and OP which illustrate a band gap voltage reference having metal oxide semiconductors according to the prior art. The circuit includes identical bipolar transistors, ten of which are connected in parallel and provided with the same reference symbol T2, so as to show that these ten individual transistors can be replaced, such as by a single transistor having correspondingly larger emitter or collector areas.

The collectors and bases of eleven individual transistors identified by reference symbols T1 and T2 are each connected to one another, the collectors of the transistors being connected to a terminal VDD of a supply voltage source and the bases of the transistors being connected in common to a terminal GND of a reference potential. The emitter circuits of the transistor array including the transistors T1 and T2 are supplied by current sources that are formed of transistors M1 and M2 and are coupled to one another. The emitter of the transistor T1 is connected through a resistor R1 with the output circuit of the transistor M1, while the common emitter connection of the transistor array T2 is connected through a series circuit formed of resistors R3 and R2 to the output circuit of the transistor M2. The terminals of the two metal oxide semiconductor transistors M1 and M2 serving as sources are connected to a terminal VSS of the supply voltage source. The gates of the two transistors M1 and M2 are driven in common by the output of an operational amplifier OP, the inverting input of which is connected to a junction point of the resistor R1 and the emitter of the transistor T1 and the non-inverting input of which is connected to a junction point of the two series-connected resistors R2 and R3. A junction point of the resistor R2 and the output circuit of the transistor M2 is connected to a terminal VREF forming the output of the band gap circuit.

The correction device according to the invention for varying the step-up ratio of the current sources formed by the transistors M1 and M2, is parallel to the output circuit of the transistor M1. The correction device includes four switchable current sources, each two of which are identical in to one another. The current sources can be connected in parallel with the output circuit of the transistor M1, by means of a transistor switch formed transistors M9–M12. The transistors M9 and M11, on the one hand, and M10 and M12, on the other, drive the respective pairs of identical current sources. Thus, on one hand, the output circuits of the transistors M3 and M9 as well as M6 and M11, are connected in series with one another and parallel to the output circuit of the transistors M1. On the other hand, the output circuits of the transistors M4, M5 and M10 as well as M7, M8 and M12, are similarly connected in series with one another and parallel to the output circuit of the transistor M1. The gates of the transistors M3–M8, like the gates of the transistors M1 and M2, are connected in common with the output of the operational amplifier OP. The gates of the transistors M9 and M10 are connected through two inverters IV1 and IV2 with terminals SE1 and SE2 of control inputs. The gates of the transistors M11 and M12 are directly connected to the terminals SE3 and SE4 of the control inputs.

All of the transistors M1–M12 are n-channel metal oxide semiconductor transistors; however, transistors of another type can also be used. Transistors of another type can also be used for the elements T1 and T2, which in the illustrated embodiment are as n-p-n transistors.

The band gap circuit according to the prior art, that is without the transistors M3–M12 and the inverters IV1 and IV2, controls the two current reflector transistors M1 and M2, through the operational amplifier OP, in such a way that the inverting and non-inverting inputs of the operational amplifier receive the same potential. This means that the base-to-emitter voltage $U_{BE2}$ of the transistor array T2 must be lower than the base-to-emitter voltage $U_{BE1}$ of the transistor T1. The requirement for a low current density which is accordingly equally significant, is attained as shown in the drawing by the parallel connection of identical transistors. Thus currents IE1 and IE2 in the circuit of the illustrated embodiment may be identical to or different from one another, as long as the requirement for the current densities of the bipolar transistors T1 and T2 is met.

The voltage dropping across the resistor R3 is increased by means of the voltage dropping across the resistor R2. The voltage applied in the circuit at the terminal VREF relative to the reference voltage GND, has a negative sign and is composed of the sum of the base-to-emitter voltage $U_{BE1}$ and the product of the ratio of the resistors R2 to R3, the temperature voltage, which is equal to Boltzmann's constant multiplied by the absolute temperature correlated with the unit charge, and the natural logarithm of the ratio of the currents IE1 and IE2. Thus is becomes clear that the electrical variable having the positive temperature coefficient can be varied by the ratio of the resistors R2 to R3 and the ratio of the currents IE1 to IE2.

According to the invention, the compensation for the temperature coefficient is accomplished by varying the ratio of the currents IE1 to IE2 by means of trimming. To this end, currents IS1–IS4 of the switchable current sources, which are additively combined to make the current IE1, are selectively added to the current IM1 furnished by the transistor M1. The addition is effected by the transistors M9–M12. In the embodiment illustrated in the drawing, two currents at a time can be added to, or subtracted from, the current IM1 by the control inputs SE1–SE4. Prior to the trimming, the control inputs SE1–SE4 are applied to the potential of the terminal VDD of the supply voltage source. This means that the switches M9 and M10 are blocked because of the inverters IV1 and IV2 and the switches M11 and M12 conduct. The current IE1 is then obtained from the sum of the currents IM1, IS3 and IS4. The control inputs SE1–SE4 can be selectively applied to the potential of the terminal VSS of the supply voltage source by means of the trimming operation, thereby increasing or decreasing the current IE1. However, in this way, the ratio of the currents IE1 to IE2 can also be increased or decreased. The currents IS1–IS4 of the switchable current sources are logically substantially lower than the currents IM1 or IM2 of the transistors M1 and M2.

If identical transistors, having individual currents which are determined by the ratio of the channel width to the channel length, are used for the switchable current sources, then the currents IS1 and IS3 are equal to one another and are one-half the level of the currents IS2 and IS4, which are also equal to one another. Thus trimming currents IS1–IS4 of the switchable currents sources are weighted in binary fashion, so that a wide trimming range is obtained. The bipolar transistor T1 and the individual transistors of the transistor array T2 may be vertical N-P-N transistors that are produced by the p-tub CMOS process, in the embodiment shown in the drawing. A particularly advantageous embodiment is provided if the emitter is provided in the form of a ring emitter about the base contact, thereby producing a substantially better current amplification of the bipolar transistors, because of the larger emitter area. At the same time, the reliability of a band gap circuit having ring emitters is increased, as compared to a band gap circuit in which the emitters are located in the middle of the base region.

The accuracy attainable in a trimmable band gap circuit according to the invention, in the temperature range from +10° C. to +70° C., is better than 10 pulse-position modulation per degree Celsius.

The foregoing is a description corresponding in substance to German Application P 35 34 891.7, dated Sept. 30, 1985, the International priority of which is being claimed for the instant application, and which is hereby made part of this application. Any material discrepancies between the foregoing specification and the aforementioned corresponding German application are to be resolved in favor of the latter.

We claim:

1. Circuit for generating a temperature-independent reference voltage, comprising transistors, having control inputs, forming current sources, a band gap circuit having two branches, and having bipolar transistors, each branch being supplied by one of said current sources; one of said branches having a common emitter connection of said bipolar transistors and two resistors in a series connection with said common emitter connection, the other branch having an emitter and a single resistor in series therewith; an operational amplifier having two inputs, each connected with a respective one of said branches, and an output connected to the control input of said current source transistors; and means including switchable current sources for adjusting the ratio of the emitter currents of said bipolar transistors.

2. Circuit according to claim 1, wherein said current sources include a first current source and second switchable current sources parallel to said first current source.

3. Circuit according to claim 2, including means for individually switching said second current sources.

4. Circuit according to claim 2, including means for switching on a portion and switching off a portion of said second current sources.

5. Circuit according to claim 3, wherein said switching means are in the form of transistors.

6. Circuit according to claim 4, wherein said switching means are in the form of transistors.

7. Circuit according to claim 2, wherein said second current sources supply currents weighted in binary fashion.

8. Circuit according to claim 2, wherein said second current sources are formed of identical transistors of one conduction type being connected in parallel.

9. Circuit according to claim 2, wherein said second current sources are formed of identical transistors of one conduction type said transistors being connected in series.

10. Circuit according to claim 5, wherein said transistors of said current sources and said transistors of said switching means are metal oxide semiconductors.

11. Circuit according to claim 6, wherein said transistors of said current sources and said transistors of said switching means are metal oxide semiconductors.

12. Circuit according to claim 1, wherein said bipolar transistors of said band gap circuit have ring emitters disposed about a base contact.

* * * * *